US008920711B2

(12) United States Patent
Colavito et al.

(10) Patent No.: US 8,920,711 B2
(45) Date of Patent: Dec. 30, 2014

(54) LANCE FOR WIRE FEEDING

(75) Inventors: Dominick M. Colavito, Bangor, PA (US); Gregory J. Kennedy, Saylorsburg, PA (US); Yu-Ming Liang, Bethlehem, PA (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 299 days.

(21) Appl. No.: 13/554,422

(22) Filed: Jul. 20, 2012

(65) Prior Publication Data

US 2014/0021663 A1 Jan. 23, 2014

(51) Int. Cl.
*C21C 7/00* (2006.01)

(52) U.S. Cl.
USPC ..... 266/225; 266/44; 266/216

(58) Field of Classification Search
CPC ..... C21B 7/16; C21C 5/4606; C21C 5/4613
USPC ..... 266/44, 216, 225
See application file for complete search history.

(56) References Cited

U.S. PATENT DOCUMENTS

| | | | | |
|---|---|---|---|---|
| 3,206,183 | A | 9/1965 | Marwick, Jr. | |
| 3,353,808 | A | 11/1967 | Norburn | |
| 3,481,201 | A | 12/1969 | Falk | |
| 3,534,614 | A | 10/1970 | Creswell | |
| 3,632,096 | A | 1/1972 | Perry | |
| 3,905,238 | A | 9/1975 | Falk | |
| 3,913,404 | A | 10/1975 | Boron | |
| 3,942,775 | A | 3/1976 | LaBate | |
| 3,996,803 | A | 12/1976 | Falk | |
| 4,002,072 | A | 1/1977 | Collins | |
| 4,089,223 | A | 5/1978 | Collins | |
| 4,093,193 | A * | 6/1978 | Cassidy et al. | 266/87 |
| 4,154,604 | A | 5/1979 | Gruner et al. | |
| 4,200,456 | A | 4/1980 | Fujii | |
| 4,247,324 | A * | 1/1981 | Guarino et al. | 75/304 |
| 4,297,133 | A | 10/1981 | Fujii | |
| 4,356,994 | A | 11/1982 | Thornton | |
| 4,423,858 | A | 1/1984 | Östlund | |
| 4,489,604 | A | 12/1984 | Kumbrant et al. | |
| 4,512,800 | A | 4/1985 | Wirth, Jr. | |
| 4,608,107 | A | 8/1986 | Falcomato | |
| 4,662,614 | A | 5/1987 | Larsson | |
| 4,705,261 | A * | 11/1987 | Wirth, Jr. | 266/287 |

(Continued)

FOREIGN PATENT DOCUMENTS

JP S54 79113 A 6/1979

OTHER PUBLICATIONS

Extended European Search Report for Application No. EP 13177005.9, dated Oct. 31, 2013 (9 pages).

*Primary Examiner* — Scott Kastler
(74) *Attorney, Agent, or Firm* — Leon Nigohosian, Jr.

(57) ABSTRACT

A lance for feeding an additive wire into a quantity of molten metal below the surface of the molten metal. The lance has an inlet end which receives additive wire and an outlet end which dispenses the additive wire. The lance has an exterior sleeve of cardboard which has an inner surface. A portion of the inner surface of the exterior sleeve contacts an interior sleeve made of a refractory material. At the inlet end of the lance is a cardboard inlet outer sleeve and a cardboard inlet inner sleeve inside of the outer sleeve. The lance can have a coupling for fitting to a wire feeding apparatus.

20 Claims, 4 Drawing Sheets

(56) References Cited

U.S. PATENT DOCUMENTS

| | | | |
|---|---|---|---|
| 4,729,548 | A | 3/1988 | Sullins |
| 4,781,776 | A | 11/1988 | Sullins |
| 4,783,057 | A | 11/1988 | Sullins |
| 4,802,940 | A | 2/1989 | Sullins |
| 4,875,380 | A | 10/1989 | Boron |
| 5,014,561 | A | 5/1991 | Falk et al. |
| 5,066,350 | A | 11/1991 | Sullins |
| 5,131,633 | A | 7/1992 | Brinker |
| 5,588,324 | A | 12/1996 | Speranza |
| 5,975,755 | A | 11/1999 | Roberson |
| 6,212,218 | B1 | 4/2001 | Shver |
| 6,497,154 | B1 | 12/2002 | Yamamoto et al. |
| 6,770,366 | B2 | 8/2004 | Riche et al. |
| 7,458,286 | B2 | 12/2008 | Plessers et al. |
| 7,621,191 | B2 | 11/2009 | Knevels et al. |
| 7,691,321 | B2 | 4/2010 | Downie |
| 7,829,010 | B2 | 11/2010 | Schwadron et al. |
| 2006/0216447 | A1 | 9/2006 | Schwadron et al. |
| 2007/0040308 | A1 | 2/2007 | Ekman et al. |
| 2009/0057964 | A1 | 3/2009 | Colavito et al. |

* cited by examiner

LANCE FOR WIRE FEEDING

FIELD OF THE INVENTION

The present invention relates to methods and apparatuses for metal production.

BACKGROUND

In the production of steel, a ferrous melt is typically produced in a suitable furnace and then tapped into a ladle where it is treated with one or more ingredients for refining or alloying purposes. It is well known to add calcium or other additives to the molten ferrous material at this point as a refining agent for oxide inclusion flotation, oxide inclusion, morphology modification, desulfurization, chemistry modification, etc. These additives are often fed in a wire which can be clad for ease of handling of the additive. Several methods of introducing the wire into the molten metal bath exist. One method uses a wire feeding apparatus and a lance. Another method uses a wire feeding apparatus and a directional conduit which feeds wire from above the bath without the use of a penetrating lance. This method is also known as surface feeding.

Previously, lances for wire feeding apparatuses were bulky, heavy, in order to be durable in a molten metal plant environment. Such systems require crane lifts and or heavy manual lifting during use and maintenance. Availability of the crane when needed to facilitate the changing of the lance can be limited. These heavy lances remain useful for multiple treatments of wire feeding as they are designed for long term durability. During this period of use of the heavy lances, slag and/or metal may become built up on the lance, often at the level where the upper surface of the slag contacts the lance during its penetration of the molten metal bath. This buildup of metal or slag which occurs and becomes larger from repeated use can unexpectedly fall off the lance such as during changing of a lance tip possibly injuring personnel or creating other safety issues. In addition, any buildup of metal or slag on the lance can prevent movement of the lance through a cover on the molten metal vessel. If this buildup on the lance itself falls off in one large piece, then a potential splash of liquid steel and slag could result in injury or property damage.

In order for heavy lances to achieve maximum durability, they often have replaceable tips as the tip tends to wear out before the main body of the lance. Several tips may be used during the useful lifetime of a single lance. Replacement of heavy lance tips are often done manually, sometimes from awkward positions for personnel. In addition, the replacement of the tips must be performed by personnel while working beneath a suspended lance. Such used lances which are configured for heavy lance tips are often covered by a buildup of slag or metal.

In surface fed wire systems, the penetration into the molten bath by the wire can be difficult if the slag is very viscous or thick. The wire can be bent or deflected by this slag layer preventing the wire from entering the molten bath and an unsuccessful wire treatment can result.

In an attempt to overcome the above-mentioned problems, the inventors have developed a lance which avoids the specified hazards while permitting the feeding of wire to the molten metal bath and achieving effective recovery.

SUMMARY

According to an embodiment of the invention, a lance for feeding an additive wire into a quantity of molten metal below the surface of the molten metal surface is disclosed. Also disclosed is a method of feeding an additive wire into a molten metal using the lance. The lance comprises a lance inlet for receiving additive wire to be fed into molten metal and a lance outlet for dispensing the additive wire to a molten metal. The lance has a passage or channel provided between the inlet and the outlet for the additive wire being fed through the lance. The lance has an exterior sleeve made of cardboard, paper board or other paper or cellulose materials or other material which retains form and retains its strength until consumed in the molten metal bath.

The exterior sleeve has a passage and an inner surface extending along the inside of the exterior sleeve from an exterior sleeve inlet of the exterior sleeve to an exterior sleeve outlet of the exterior sleeve. A first interior sleeve is provided on the inner surface of the exterior sleeve passage and extends from a first end of the interior sleeve at which the additive wire is dispensed to a second end of the interior sleeve. The second end of the first interior sleeve is located at a distance from the inlet end of the lance, i.e. the wire receiving end of the lance. The first interior sleeve can be refractory material. A second interior sleeve is provided along a portion of the passage of the exterior sleeve and extends from the second end of the first interior sleeve to the outlet end of the wire receiving end of the lance.

According to an embodiment of the invention, a lance for feeding an additive wire into a quantity of molten metal below the surface of the molten metal surface is disclosed. Also disclosed is a method of feeding an additive wire into a molten metal using the lance. The lance comprises a lance inlet for receiving additive wire to be fed into molten metal and a lance outlet for dispensing the additive wire to a molten metal. The lance has a passage or channel provided between the inlet and the outlet for the additive wire being fed through the lance. The lance has an exterior sleeve made of cardboard, paper board or other cellulosic material or other material which retains form and retains its strength until consumed in the molten metal bath.

The exterior sleeve has a passage and an inner surface extending along the inside of the exterior sleeve from an exterior sleeve inlet of the exterior sleeve to an exterior sleeve outlet of the exterior sleeve. A first interior sleeve is provided on the inner surface of the exterior sleeve passage and extends from a first end of the interior sleeve at which the additive wire is dispensed to a second end of the interior sleeve. The second end of the first interior sleeve is located at a distance from the inlet end of the lance, i.e. the wire receiving end of the lance. The first interior sleeve can be refractory material.

An inner inlet sleeve having an inner surface extending along a passage in the inner inlet sleeve is provided along a portion of the passage of the exterior sleeve and extends from the second end of the first interior sleeve to a distance from the outlet end of the wire receiving end of the lance. An outer inlet sleeve having an inner surface extending along a passage in the outer inlet sleeve is provided along the inner surface of the outer inlet sleeve and extends from the second end of the first interior sleeve to a distance from the outlet end of the wire receiving end of the lance.

According to an embodiment of the invention, a lance for feeding an additive wire into a quantity of molten metal below the surface of the molten metal surface is disclosed. Also disclosed is a method of feeding an additive wire into a molten metal using the lance. The lance comprises a lance inlet for receiving additive wire to be fed into molten metal and a lance outlet for dispensing the additive wire to a molten metal. The lance has a passage or channel provided between the inlet and the outlet for the additive wire being fed through the lance.

The lance has an exterior sleeve made of cardboard, paper board or other cellulosic material or other material which retains form and retains its strength until consumed in the molten metal bath. The exterior sleeve has a passage and an inner surface extending along the inside of the exterior sleeve from an exterior sleeve inlet of the exterior sleeve to an exterior sleeve outlet of the exterior sleeve. A first interior sleeve is provided on the inner surface of the exterior sleeve passage and extends from a first end of the interior sleeve at which the additive wire is dispensed to a second end of the interior sleeve. The lance can have a joining means to engage with a wire feeding apparatus.

In some embodiments, the lance can have a guide tube for permitting passage of the wire through the lance. The guide tube can be tapered at the outlet end of the lance.

In some embodiments, the lance can have a joining means to engage with a wire feeding apparatus.

In some embodiments, the lance has an exterior refractory sleeve, an exterior cardboard sleeve along the inner surface of the exterior refractory sleeve, a first interior sleeve of refractory material, a tapered guide tube and a joining means.

In some embodiments, the lance has a second exterior sleeve of cardboard, an exterior refractory sleeve, a first exterior sleeve of cardboard, a first interior sleeve of refractory material, a tapered guide tube and a joining means.

Some embodiments of the invention are also directed to a method of using a lance as described above.

The various embodiments of the invention will be described with the aid of the following drawings, in which, like reference numbers represent like elements.

All drawings are schematic illustrations and the structures rendered therein are not intended to be in scale. It should be understood that the invention is not limited to the precise arrangements and instrumentalities shown, but is limited only by the scope of the claims.

DETAILED DESCRIPTION OF THE INVENTION

According to an embodiment of the invention, a lance for feeding an additive wire into a quantity of molten metal below the surface of the molten metal surface is disclosed. Also disclosed is a method of feeding an additive wire into a molten metal using the lance. The lance comprises a lance inlet for receiving additive wire to be fed into molten metal and a lance outlet for dispensing the additive wire to a molten metal. The lance has a passage or channel provided between the inlet and the outlet for the additive wire being fed through the lance. The lance has an exterior sleeve made of cardboard, paper board or other cellulosic material.

The exterior sleeve has a passage and an inner surface extending along the inside of the exterior sleeve from an exterior sleeve inlet of the exterior sleeve to an exterior sleeve outlet of the exterior sleeve. A first interior sleeve is provided on the inner surface of the exterior sleeve passage and extends from a first end of the interior sleeve at which the additive wire is dispensed to a second end of the interior sleeve. The second end of the first interior sleeve is located at a distance from the inlet end of the lance, i.e. the wire receiving end of the lance. The first interior sleeve can be refractory material. A second interior sleeve is provided along a portion of the passage of the exterior sleeve and extends from the second end of the first interior sleeve to the outlet end of the wire receiving end of the lance.

Figure 1A:
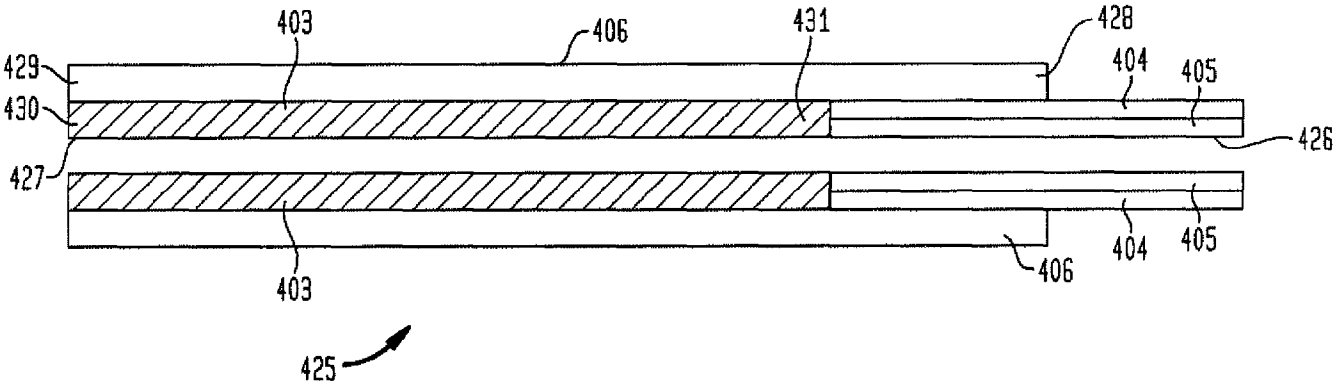
FIG. 1A is a cross-sectional side view of a lance according to the invention showing an exterior sleeve of cardboard, a first interior sleeve of refractory material and an inner inlet sleeve and an outer inlet sleeve of cardboard.

As seen in FIG. 1A, a lance 425 for feeding an additive wire into a quantity of molten metal below the surface of the molten metal surface is disclosed. The lance 425 comprises a lance inlet 426 for receiving additive wire to be fed into molten metal and a lance outlet 427 for dispensing the additive wire to a molten metal. The lance 425 has a passage or channel provided between the lance inlet 426 and the lance outlet 427 for the additive wire being fed through the lance 425. The lance 425 has an exterior sleeve 406 made of cardboard, paper board or other cellulosic or other material which retains form and retains its strength until consumed in the molten metal bath.

The exterior sleeve 406 has a passage and an inner surface along the passage extending along the inside of the exterior sleeve 406 from an exterior sleeve inlet 428 of the exterior sleeve 406 to an exterior sleeve outlet 429 of the exterior sleeve 406. A first interior sleeve 403 which comprises refractory material is provided on the inner surface of the exterior sleeve passage and extends from a first end 431 of the first interior sleeve 403 at which the additive wire is provided into the first interior sleeve 403 to a second end 430 of the first interior sleeve 403. The first end 431 of the first interior sleeve 403 is located at a distance from the lance inlet, i.e. the wire receiving end of the lance 425. The first interior sleeve 403 can be refractory material.

An outer inlet sleeve 404 extends along a portion of the passage of the exterior sleeve 406 and extends from the first end 431 of the first interior sleeve 403 to the lance inlet 426 of the lance 425. The outer inlet sleeve 404 has an inner surface extending along a passage in the outer inlet sleeve 404. An inner inlet sleeve 405 is provided along the inner surface of the outer inlet sleeve 404 and extends from the first end 431 of the first interior sleeve 403 to a distance from the lance inlet 426. The end of the inner inlet sleeve 405 which receives additive wire from the wire feeding apparatus can be staggered relative to the end of the outer inlet sleeve 404 which receives the wire such that the wire receiving end of the inner inlet sleeve 405 is closer to the lance inlet 426 than the wire receiving end of the outer inlet sleeve 404.

Figure 1B:
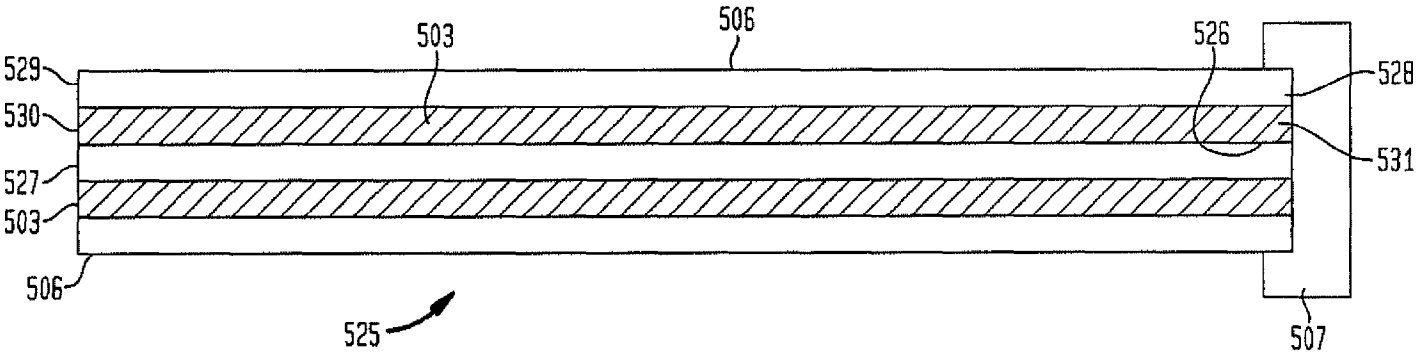
FIG. 1B is a cross-sectional side view of a lance according to the invention showing an exterior sleeve of cardboard, a first interior sleeve of refractory material and a joining means.

As seen in FIG. 1B, a lance 525 for feeding an additive wire into a quantity of molten metal below the surface of the molten metal surface is disclosed. The lance 525 comprises a lance inlet 526 for receiving additive wire to be fed into molten metal and a lance outlet 527 for dispensing the additive wire to a molten metal. The lance 525 has a passage or channel provided between the lance inlet 526 and the lance outlet 527 for the additive wire being fed through the lance 525. The lance has an exterior sleeve 506 made of cardboard, paper board or other cellulosic or other material which retains form and retains strength until consumed in the molten metal bath.

The exterior sleeve 506 has a passage and an inner surface extending along the inside of the exterior sleeve 506 from an exterior sleeve inlet 528 of the exterior sleeve 506 to an exterior sleeve outlet 529 of the exterior sleeve 506. A first interior sleeve 503 which comprises refractory material is provided on the inner surface of the exterior sleeve 506 and extends from a first end 531 of the first interior sleeve 503 at which the additive wire is provided to a second end 530 of the first interior sleeve 503. The lance 525 can have a joining means 507 to engage with a wire feeding apparatus. The joining means 507 can be a clamp.

Figure 2A:
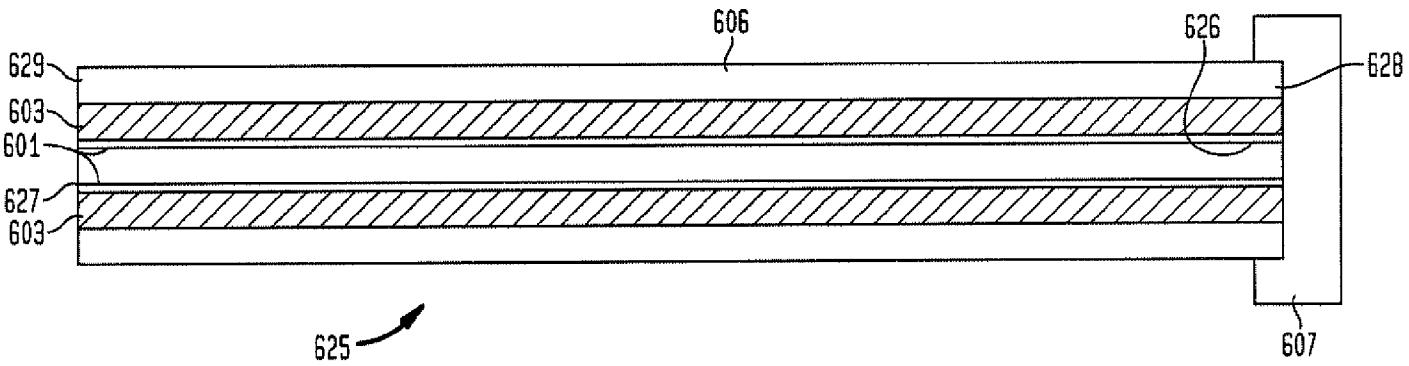
FIG. 2A is a cross-sectional side view of a lance according to the invention showing an exterior sleeve of cardboard, a first interior sleeve of refractory material, a guide tube and a joining means.
Figure 2:
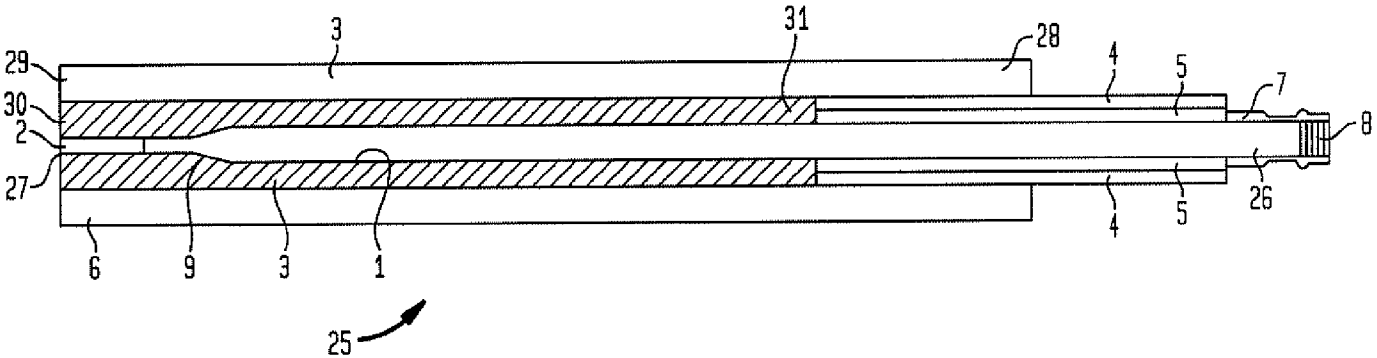
FIG. 2 is a cross-sectional side view of a lance according to the invention showing an exterior sleeve of cardboard, a first interior sleeve of refractory material, an inner inlet sleeve, an outer inlet sleeve of cardboard, a guide tube and a joining means.

As seen in FIG. 2, a lance 25 for feeding an additive wire into a quantity of molten metal below the surface of the molten metal surface is disclosed. The lance 25 comprises a lance inlet 26 for receiving additive wire to be fed into molten metal and a lance outlet 27 for dispensing the additive wire to a molten metal. The lance 25 has a passage or channel provided between the lance inlet 26 and the lance outlet 27 for the additive wire being fed through the lance 25. The lance 25 has an exterior sleeve 6 made of cardboard, paper board or other cellulosic or other material which retains form and retains strength until consumed in the molten metal bath.

The exterior sleeve 6 has a passage and an inner surface along the passage extending along the inside of the exterior sleeve 6 from an exterior sleeve inlet 28 of the exterior sleeve 6 to an exterior sleeve outlet 29 of the exterior sleeve 6. A first interior sleeve 3 which comprises refractory material is provided on the inner surface of the exterior sleeve passage and extends from a first end 31 of the first interior sleeve 3 at which the additive wire is provided into the first interior sleeve 3 to a second end 30 of the first interior sleeve 3. The first end 31 of the first interior sleeve 3 is located at a distance from the lance inlet, i.e. the wire receiving end of the lance 25. The first interior sleeve 3 can be refractory material.

An outer inlet sleeve 4 extends along a portion of the passage of the exterior sleeve 6 and extends from the first end 31 of the first interior sleeve 3 to the lance inlet 26 of the lance. The outer inlet sleeve 4 has an inner surface extending along a passage in the outer inlet sleeve 4. An inner inlet sleeve 5 is provided along the inner surface of the outer inlet sleeve 4 and extends from the first end 31 of the first interior sleeve 3 to a distance from the lance inlet 26 of the wire receiving end of the lance 25.

The lance has a guide tube 1 for permitting passage of the wire through the lance 25. As seen in FIG. 2, the guide tube 1 has a tapered portion 9 at the outlet end of the lance 25. Optionally, the lance 25 has plug or dowel 2 which can be made of wood. The joining means can have a threaded portion 8 for engaging with the wire feeding apparatus.

As seen in FIG. 2A below, a lance 625 for feeding an additive wire into a quantity of molten metal below the surface of the molten metal surface is disclosed. The lance 625 comprises a lance inlet 626 for receiving additive wire to be fed into molten metal and a lance outlet 627 for dispensing the additive wire to a molten metal. The lance 625 has a passage or channel provided between the lance inlet 626 and the lance outlet 627 for the additive wire being fed through the lance 625. The lance 625 has an exterior sleeve 606 made of cardboard, paper board or other cellulosic or other material which retains form and retains strength until consumed in the molten metal bath.

The exterior sleeve 606 has a passage and an inner surface along the passage extending along the inside of the exterior sleeve 606 from an exterior sleeve inlet 628 of the exterior sleeve 606 to an exterior sleeve outlet 629 of the exterior sleeve 606. A first interior sleeve 603 which comprises refractory material is provided on the inner surface of the exterior sleeve passage and extends from a first end 631 of the first interior sleeve 3 at which the additive wire is dispensed into the first interior sleeve 3 to a second end 30 of the first interior sleeve 603. The first end 631 of the first interior sleeve 603 is located at the wire receiving end of the lance 625. The first interior sleeve 603 can be refractory material.

The lance has a guide tube 601 for permitting passage of the wire through the lance. A joining means 607 can be a clamp engaging the lance with the wire feeding apparatus.

Figure 3:
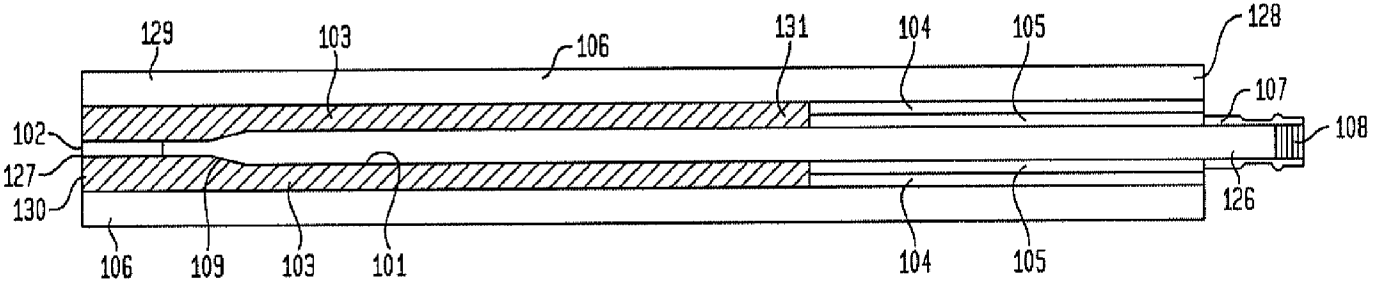
FIG. 3 is a cross-sectional side view of a lance according to the invention showing an exterior sleeve of cardboard, a first interior sleeve of refractory material, a tapered guide tube and a joining means.

As seen in FIG. 3, a lance 125 for feeding an additive wire into a quantity of molten metal below the surface of the molten metal surface is disclosed. The lance 125 comprises a lance inlet 126 for receiving additive wire to be fed into molten metal and a lance outlet 127 for dispensing the additive wire to a molten metal. The lance 125 has a passage or channel provided between the lance inlet 126 and the lance outlet 127 for the additive wire being fed through the lance 125. The lance 125 has an exterior sleeve 106 made of cardboard, paper board or other cellulosic or other material which retains form and retains strength until consumed in the molten metal bath.

The exterior sleeve 106 has a passage and an inner surface along the passage extending along the inside of the exterior sleeve 106 from an exterior sleeve inlet 128 of the exterior sleeve 106 to an exterior sleeve outlet 129 of the exterior sleeve 106. A first interior sleeve 103 which comprises refractory material is provided on the inner surface of the exterior sleeve passage and extends from a first end 131 of the first interior sleeve 103 at which the additive wire is provided into the first interior sleeve 103 to a second end 130 of the first interior sleeve 103. The first end 131 of the first interior sleeve 103 is located at a distance from the lance inlet, i.e. the wire receiving end of the lance 125. The first interior sleeve 103 can be refractory material.

An outer inlet sleeve 104 extends along a portion of the passage of the exterior sleeve 106 and extends from the first end 131 of the first interior sleeve 103 to the lance inlet 126 of the lance. The outer inlet sleeve 104 has an inner surface extending along a passage in the outer inlet sleeve 104. An inner inlet sleeve 105 is provided along the inner surface of the outer inlet sleeve 104 and extends from the first end 131 of the first interior sleeve 103 to a distance from the lance inlet 126 of the wire receiving end of the lance 125. The inner inlet sleeve 105 and outer inlet sleeve extend in the direction of the lance inlet 126 as far as the exterior sleeve 106.

The lance has a guide tube 101 for permitting passage of the wire through the lance 125. As seen in FIG. 3, the guide tube 101 has a tapered portion 109 at the outlet end of the lance 125. Optionally, the lance 125 has plug or dowel 102 which can be made of wood. The joining means can have a threaded portion 108 for engaging with the wire feeding apparatus.

In some embodiments, the lance has an exterior refractory sleeve, an exterior cardboard sleeve along the inner surface of the exterior refractory sleeve, a first interior sleeve of refractory material, a tapered guide tube and a joining means.

Figure 4:
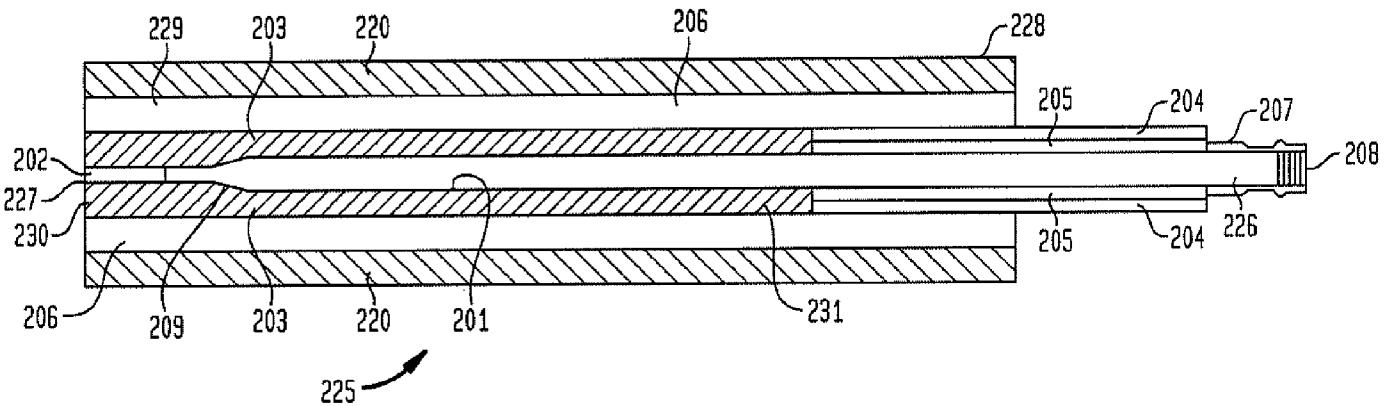
FIG. 4 is a cross-sectional side view of a lance according to the invention showing an exterior sleeve of cardboard, an exterior refractory sleeve, a first interior sleeve of refractory material, a tapered guide tube and a joining means.

As seen in FIG. 4, a lance 225 for feeding an additive wire into a quantity of molten metal below the surface of the molten metal surface is disclosed. The lance 225 comprises a lance inlet 226 for receiving additive wire to be fed into molten metal and a lance outlet 227 for dispensing the additive wire to a molten metal. The lance 225 has a passage or channel provided between the lance inlet 226 and the lance outlet 227 for the additive wire being fed through the lance 225. The lance 225 has an exterior sleeve 206 made of cardboard, paper board or other cellulosic or other material which retains form and retains strength until consumed in the molten metal bath.

The exterior sleeve 206 has a passage and an inner surface along the passage extending along the inside of the exterior sleeve 206 from an exterior sleeve inlet 228 of the exterior sleeve 206 to an exterior sleeve outlet 229 of the exterior sleeve 206. A first interior sleeve 203 which comprises refractory material is provided on the inner surface of the exterior sleeve passage and extends from a first end 231 of the first interior sleeve 203 at which the additive wire is provided into the first interior sleeve 203 to a second end 230 of the first interior sleeve 203. The first end 231 of the first interior sleeve 203 is located at a distance from the lance inlet, i.e. the wire receiving end of the lance 225. The first interior sleeve 203 can be refractory material.

The lance 225 has an exterior refractory sleeve 220 which has a passage therethrough having an inner surface along the passage. The exterior sleeve 206 is provided in the passage of the exterior refractory sleeve 220 and comprises refractory material or can be made of refractory material.

An outer inlet sleeve 204 extends along a portion of the passage of the exterior sleeve 206 and extends from the first end 231 of the first interior sleeve 203 to the lance inlet 226 of the lance. The outer inlet sleeve 204 has an inner surface extending along a passage in the outer inlet sleeve 204. An inner inlet sleeve 205 is provided along the inner surface of the outer inlet sleeve 204 and extends from the first end 231 of the first interior sleeve 203 to a distance from the lance inlet 226 of the wire receiving end of the lance 225.

The lance has a guide tube 201 for permitting passage of the wire through the lance 225. As seen in FIG. 4, the guide tube 201 has a tapered portion 209 at the outlet end of the lance 225. Optionally, the lance 225 has plug or dowel 202 which can be made of wood. The joining means can have a threaded portion 208 for engaging with the wire feeding apparatus.

In some embodiments, the lance has a second exterior sleeve of cardboard, an exterior refractory sleeve, a first exterior sleeve of cardboard, a first interior sleeve of refractory material, a tapered guide tube and a joining means.

Figure 5:
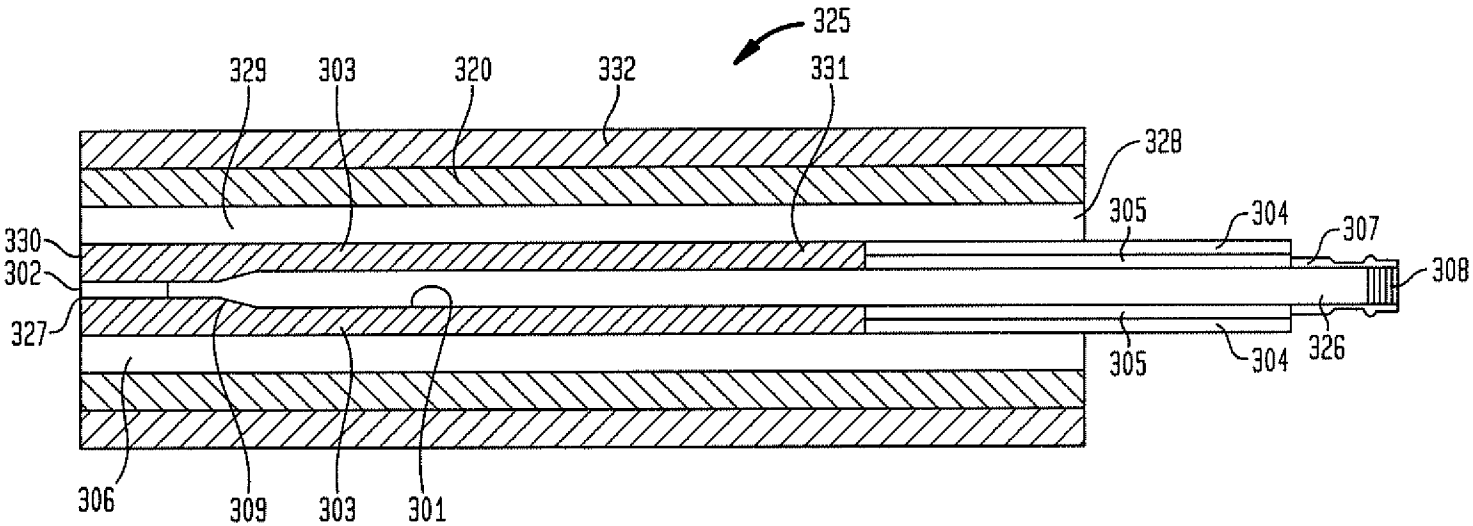
FIG. 5 is a cross-sectional side view of a lance according to the invention showing a second exterior sleeve of cardboard, an exterior refractory sleeve, a first exterior sleeve of cardboard, a first interior sleeve of refractory material, a tapered guide tube and a joining means.

As seen in FIG. 5, a lance 325 for feeding an additive wire into a quantity of molten metal below the surface of the molten metal surface is disclosed. The lance 325 comprises a lance inlet 326 for receiving additive wire to be fed into molten metal and a lance outlet 327 for dispensing the additive wire to a molten metal. The lance 325 has a passage or channel provided between the lance inlet 326 and the lance outlet 327 for the additive wire being fed through the lance 325. The lance 325 has a first exterior sleeve 306 made of cardboard, paper board or other cellulosic or other material which retains form and retains strength until consumed in the molten metal bath.

The first exterior sleeve 306 has a passage and an inner surface along the passage extending along the inside of the first exterior sleeve 306 from an exterior sleeve inlet 328 of the first exterior sleeve 306 to an exterior sleeve outlet 329 of the first exterior sleeve 306. A first interior sleeve 303 which comprises refractory material is provided on the inner surface of the exterior sleeve passage and extends from a first end 331 of the first interior sleeve 303 at which the additive wire is provided into the first interior sleeve 303 to a second end 330 of the first interior sleeve 303. The first end 331 of the first interior sleeve 303 is located at a distance from the lance inlet, i.e. the wire receiving end of the lance 325. The first interior sleeve 303 can be refractory material.

The lance 325 has an exterior refractory sleeve 320 which has a passage therethrough having an inner surface along the passage. The first exterior sleeve 306 is provided in the passage of the exterior refractory sleeve 320. The lance 325 also has a second exterior sleeve 332 which has a passage therethrough having an inner surface along the passage. The exterior refractory sleeve 320 is provided in the passage of the second exterior sleeve 332 which can be cardboard, paperboard or other cellulosic materials.

An outer inlet sleeve 304 extends along a portion of the passage of the first exterior sleeve 306 and extends from the first end 331 of the first interior sleeve 303 to the lance inlet 326 of the lance. The outer inlet sleeve 304 has an inner surface extending along a passage in the outer inlet sleeve 304. An inner inlet sleeve 305 is provided along the inner surface of the outer inlet sleeve 304 and extends from the first end 331 of the first interior sleeve 303 to a distance from the lance inlet 326 of the wire receiving end of the lance 325.

The lance has a guide tube 301 for permitting passage of the wire through the lance 325. As seen in FIG. 5, the guide tube 301 has a tapered portion 309 at the outlet end of the lance 325. Optionally, the lance 325 has plug or dowel 302 which can be made of wood. The joining means can have a threaded portion 308 for engaging with the wire feeding apparatus.

Some embodiments of the invention are also directed to a method of using a lance as described below.

The lance and method of using the lance permits feeding of the additive wire to depths in the melt of up to approximately six feet to allow enhanced recovery of the additives such as calcium. Also, because the lance of the present invention is lightweight and of a smaller diameter as compared to conventional lances, the present lance has the advantage of permitting changing of the lance without the need for a crane or other machinery for moving heavy objects.

According to the method of the present invention, there is no need to change a lance tip during use. The whole lance itself can be changed at one time manually without the need to change a heavy lance tip, either by manual means or with the assistance of machinery for heavy lifting.

Because the lance can be used economically for one use and disposed of after one use, the method of using the lance of the present invention avoids the undesirable buildup of metal or slag on the lance which can fall off and cause injury or property damage. Because the buildup of slag or metal on the lance is avoided, no slag or metal is present on the lance to block passage of the lance through a hole in a cover on the metallurgical vessel.

Because each lance is a low cost disposable unit as compared to expensive traditional lances, in the case of damage to one unit economic loss is minimized.

In short, use of the lance of the present invention avoids the need for a bulky support system such as that which holds traditional lance and lance tip combinations. In spite of the lighter weight and smaller size of the lance of the present invention the lance still permits the penetration of thick viscous slag layers on a molten metal bath as opposed to surface wire feeding to achieve successful treatments with acceptable additive recovery.

The first exterior sleeve or second exterior sleeve of the lance can be cardboard, paperboard or any other cellulosic or other material which retains form and retains strength until consumed in the molten metal bath.

The guide tube can be any tube or pipe which is provided in the interior sleeve which permits passage of the additive wire through the lance. The guide tube can be made of steel or other metals.

The outer sleeve can be of a nominal outside diameter of from 1 to 4 inches, preferably 2 inches.

The joining means can be any means for joining the lance to a wire feeding apparatus such as a clamp, coupling, quick disconnect or other mechanical device which joins the lance to a wire feeding apparatus.

The refractory material of the inner sleeve can be a dense magnesia-based refractory material or a lightweight refractory material, preferably a magnesia based refractory. The refractory material can be magnesia, olivine, fireclay, dolomite, calcia, zirconia, alumina, silica, chromite, graphite, zircon, magnesia-carbon, magnesia-chrome and mixtures thereof.

High temperature binders useful in the refractory of the interior sleeve include but are not limited to resins such as phenolic resins, sodium phosphate, potassium phosphate, ammonium phosphate, magnesium phosphate, calcium phosphate, sodium silicate, potassium silicate, magnesium silicate, calcium silicate, sodium sulfate, potassium sulfate, magnesium sulfate, calcium sulfate, ammonium sulfate, zirconium sulfate, and aluminum sulfate, preferably sodium silicate. These plasticizers and high temperature binders are commercially available.

A coating can be provided on the exterior sleeve which protects the lance in the environment near or above the molten metal vessel. The coating can be an intumescent or refractory coating that helps prevent the burning of the exterior of the sleeve. For example, a sodium silicate solution can be applied as a coating on the lance exterior.

The lance of the present invention can be used for feeding wire into a molten metal bath such as by the method as described below.

TABLE 1

Resin bonded dry vibratable refractory material

| Raw Material | Description | Wt. Percent |
|---|---|---|
| Magnesia 97 MgO | −1 mm | 75.5 |
| Magnesia 97 MgO | Powder | 16.0 |
| Phenolic Resin | Powder | 5.0 |
| Sodium Silicate | Anhydrous Powder | 2.0 |
| Silicon Metal | Fines, −325 Mesh | 1.5 |
| | Total | 100.0 |

TABLE 2

Wet cast refractory material

| Raw Material | Description | Wt. Percent |
|---|---|---|
| Magnesia 97 MgO | −1 mm | 65.0 |
| Magnesia 97 MgO | Powder | 20.0 |

TABLE 2-continued

Wet cast refractory material

| Raw Material | Description | Wt. Percent |
|---|---|---|
| Calcium Hydroxide | Powder | 8.0 |
| Calcium Carbonate | Powder | 4.0 |
| Sulfamic Acid | Powder | 3.0 |
| | Total | 100.0 |

EXAMPLE 1

Resin Bonded Dry Vibratable Refractory Sleeve in Lance

A cardboard tube of 2.0 inches was provided as an outer sleeve and a steel tube was provided inside the outer sleeve. The above formulation of a dry vibratable in the form of a powder was poured between the steel tube and the outer sleeve. The entire assembly was vibrated in place in a jig to hold the outer sleeve and steel tube in a concentric arrangement. Then the above assembly is placed into an oven and heated to 350 degrees Fahrenheit and held at 350 degrees F. for three hours. The cured piece was then allowed to cool.

A lance made according to the above formulation was mounted onto a support structure for the lance in a steel making plant. At this steel making shop the lance was tested on a steel ladle containing a grade of steel that was covered with a thick layer of highly viscous slag. This particular shop has slags that are very difficult to penetrate with a lance or a surface fed wire. The lance was lowered partially into the steel melt and held in position for a total of six minutes. The test was successful and after being partially immersed in the melt a substantial portion of the lance remained intact.

EXAMPLE 2

Wet Cast Refractory Composition

A cardboard tube of 2.0 inches diameter was provided as an outer sleeve and a steel tube was provided inside the outer sleeve. A wet cast mix of the above formulation of Table 2 was poured between the steel tube and the outer sleeve. The entire assembly was vibrated in place in a jig to hold the outer sleeve and steel tube in a concentric arrangement. Three lances were made by the above described method. One of the three lances was coated with a sodium silicate solution. Then the above assemblies were placed into an oven and heated to 230 degrees Fahrenheit and held at 230 degrees F. for 48 hours. The cured pieces were then allowed to cool.

Each lance was mounted in turn onto a support structure for the lance in a steel making plant and connected to a wire feeding mechanism for feeding clad calcium wire.

1000 feet of calcium wire was fed through each of the three 72 inch lances of the present invention at a rate of 460 feet per minute into a ladle of molten steel. The lances had a one-half inch nominal steel inside diameter lightweight conduit piece which formed the channel or passage of the lances. The conduit was tapered to three-eighths of an inch inside diameter in each lance. The conduit was inside an inner sleeve of cast magnesia-based refractory material. The outer sleeve of the lances had a one-quarter inch wall thickness. The lances had a threaded coupling on the wire receiving end of the lance connected to a holder on the transport means to advance the lance into the steel and slag of the ladle. The lances penetrated the slag and steel in subsequent heats of a ladle and were held there during the entire period during which wire was fed. The recovery of calcium in the resulting steel melt was acceptable in each case. A residual portion of each of the lances of the present invention was remaining and recovered after the wire treatments.

EXAMPLE 3

Wet Cast Refractory Composition

A cardboard tube of 2.0 inches was provided as an outer sleeve and a steel tube was provided inside the outer sleeve. A wet cast mix of the above formulation of Table 2 was poured between the steel tube and the outer sleeve. The entire assembly was vibrated in place in a jig to hold the outer sleeve and steel tube in a concentric arrangement. Four lances were made by the above described method. One of the four lances was coated with a sodium silicate solution. Then the above assemblies were placed into an oven and heated to 230 degrees Fahrenheit and held at 230 degrees F. for 48 hours. The cured pieces were then allowed to coot.

Each lance was mounted in turn onto a support structure for the lance in a steelmaking plant and connected to a wire feeding mechanism for feeding clad calcium wire.

1000 feet of calcium wire was fed through each of the four different 72 inch lances of the present invention at a rate of 460 feet per minute into a ladle of molten steel. The lances had a one-half inch nominal steel inside diameter lightweight conduit piece which forms the channel of the lance. The conduit was not tapered. The conduit was inside an inner sleeve of cast magnesia-based refractory material. The outer sleeve of the lances had a one-quarter inch wall thickness. The lances had a threaded coupling on the wire receiving end connected to a holder for the lance on the transport means to advance the lance into the steel and slag of the ladle. The lances penetrated the slag and steel in a ladle and were held there during the entire period during which wire was fed. The recovery of calcium in the resulting steel melt was acceptable in each case. A residual portion of each of the lances of the present invention was remaining and recovered after the wire treatment.

The essential features of the invention having been disclosed, further variations will now become apparent to persons skilled in the art. All such variations are considered to be within the scope of the appended claims. Reference should be made to the appended claims, rather than the foregoing specification, as indicating the true scope of the subject invention.

We claim:

1. A lance for feeding an additive wire into a quantity of molten metal below the surface of the molten metal, the lance comprising:

a lance inlet for receiving additive wire and a lance outlet for dispensing additive wire to the molten metal;

a first exterior sleeve comprising a cellulosic material, the first exterior sleeve having a passage and an inner surface along the passage extending from an exterior sleeve inlet of the first exterior sleeve to an exterior sleeve outlet of the first exterior sleeve;

a first interior sleeve which comprises refractory material on the inner surface of the first exterior sleeve extending from a first end of the first interior sleeve at which the additive wire is dispensed to the molten metal by the first interior sleeve to a second end of the first interior sleeve which receives the additive wire, the second end of the first interior sleeve being located at a distance from the lance inlet; and an outer inlet sleeve extending along a portion of the passage of the first exterior sleeve and extending from the second end of the first interior sleeve to the lance inlet, the outer inlet sleeve having an inner surface extending along a passage in the outer inlet sleeve, an inner inlet sleeve provided along the inner surface of the outer inlet sleeve and extending from the second end of the first interior sleeve to the lance inlet.

2. The lance of claim 1 wherein the inner inlet sleeve extends along the entire inner surface of the outer inlet sleeve.

3. The lance of claim 1 further comprising a means for joining the lance to a wire feeding apparatus.

4. The lance of claim 3 wherein the means for joining the lance to a wire feeding apparatus is a clamp or a coupling having a threaded portion.

5. The lance of claim 1 further comprising a guide tube along an inner surface of the first interior sleeve and inner inlet sleeve.

6. The lance of claim 5 wherein the guide tube has a tapered portion at a distance from the lance outlet.

7. The lance of claim 1 further comprising a second exterior sleeve of refractory material having a passage and an inner surface along the passage wherein the first exterior sleeve is provided in the passage of the second exterior sleeve.

8. The lance of claim 7 further comprising a third exterior sleeve of a cellulosic material, the third exterior sleeve having a passage and an inner surface along the passage wherein the second exterior sleeve is provided in the passage of the third exterior sleeve.

9. The lance of claim 1 wherein the first exterior sleeve is coated with an ablative, intumescent, refractory or insulating material.

10. The lance of claim 9 wherein the coating on the first exterior sleeve is sodium silicate.

11. A lance for feeding an additive wire into a quantity of molten metal below the surface of the molten metal, the lance comprising:

a lance inlet for receiving additive wire and a lance outlet for dispensing additive wire to the molten metal;

a first exterior sleeve comprising a cellulosic material, the first exterior sleeve having a passage and an inner surface along the passage extending from an exterior sleeve inlet of the first exterior sleeve to an exterior sleeve outlet of the first exterior sleeve; and a first interior sleeve on the inner surface of the exterior sleeve extending from the lance inlet to the lance outlet, the first interior sleeve having a passage therethrough and an inner surface extending along the passage, wherein the first interior sleeve is made of a heat cured refractory material, and the heat cured refractory material is cured from (1) a dry formulation comprising magnesium oxide powder and a resin or (2) a wet cast mix formulation comprising magnesium oxide powder.

12. The lance of claim 11 further comprising a guide tube along the inner surface of the first interior sleeve.

13. The lance of claim 12 further comprising a means for joining the lance to a wire feeding apparatus.

14. A method of feeding additive wire into a molten metal bath, the method comprising:

lowering the lance of claim 1 into molten metal; and introducing an additive wire through the lance and into the molten metal while the lance outlet is in the molten metal.

15. The lance of claim 11, wherein the heat cured refractory material is cured from a dry formulation comprising magnesium oxide powder and a resin.

16. The lance of claim 11, wherein the heat cured refractory material is cured from a wet cast mix formulation comprising magnesium oxide powder.

17. The lance of claim 1, wherein the refractory material of the first interior sleeve is a heat cured refractory material, and the heat cured refractory material is cured from a dry formulation comprising magnesium oxide powder and a resin.

18. The lance of claim 1, wherein the refractory material of the first interior sleeve is a heat cured refractory material, and the heat cured refractory material is cured from a wet cast mix formulation comprising magnesium oxide powder.

19. The method of claim 14, the refractory material of the first interior sleeve is a heat cured refractory material, and the heat cured refractory material is cured from a dry formulation comprising magnesium oxide powder and a resin.

20. The method of claim 14, the refractory material of the first interior sleeve is a heat cured refractory material, and the heat cured refractory material is cured from a wet cast mix formulation comprising magnesium oxide powder.

* * * * *